US005103483A

United States Patent [19]

Klein

[11] Patent Number: 5,103,483

[45] Date of Patent: Apr. 7, 1992

[54] SPHERICAL MEMBRANE OMNIDIRECTIONAL LOUDSPEAKER USING A MAGNETOSTRICTIVE BIMETALLIC STRIP

[75] Inventor: Siegfried Klein, Paris, France

[73] Assignee: Commissariat a l'Energie Atomique, France

[21] Appl. No.: 532,455

[22] Filed: Jun. 4, 1990

[30] Foreign Application Priority Data

Jun. 15, 1989 [FR] France ..... 89 07960

[51] Int. Cl.[5] ..... H04R 25/00; H04R 15/00

[52] U.S. Cl. ..... 381/190; 381/191; 381/202; 367/168

[58] Field of Search ..... 381/190, 202, 191; 367/168; 310/26, 371

[56] References Cited

U.S. PATENT DOCUMENTS

| | | | |
|---|---|---|---|
| 2,761,077 | 8/1956 | Harris | 367/168 |
| 4,473,721 | 9/1984 | Klein | 381/190 |
| 4,665,550 | 5/1987 | Haas | 381/192 |
| 4,843,275 | 6/1989 | Radice | 381/190 |
| 4,924,503 | 5/1990 | Klein | 381/190 |

FOREIGN PATENT DOCUMENTS

| | | |
|---|---|---|
| 0177383 | 8/1985 | European Pat. Off. . |
| 0303547 | 8/1988 | European Pat. Off. . |
| 1157266 | 11/1963 | Fed. Rep. of Germany . |

*Primary Examiner*—Forester W. Isen
*Assistant Examiner*—Jason Chan
*Attorney, Agent, or Firm*—Hayes, Soloway, Hennessey & Hage

[57] ABSTRACT

The invention concerns an omnidirectional loudspeaker. This loudspeaker comprises a spherical membrane which includes spires formed of a strip (2) made of a magnetostrictive material, the spires being spiral wound according to a sphere; these spires are kept in place by an elastic support (1) so that, along with the support, they form a spherical membrane. The strip has two opposing faces (11, 12), one of which is directed towards the inside (I) of the sphere, the other being directed towards the outside (E) of the sphere, and two extremities (3, 4) situated in two diametrically opposing zones of the sphere so as to be connected to an electric control device (5) providing a signal corresponding to sound waves to be reproduced, and a device (7) for the continuous polarization of the membrane. According to the invention, one of the faces (11) of the strip (2) is at least partly coated with a thin coating (13) made of a rigid material. Invention may be applied for the diffusion of high quality omnidirectional sound waves.

12 Claims, 3 Drawing Sheets

SPHERICAL MEMBRANE OMNIDIRECTIONAL LOUDSPEAKER USING A MAGNETOSTRICTIVE BIMETALLIC STRIP

FIELD OF THE INVENTION

The present invention concerns a spherical membrane omnidirectional loudspeaker using a magnetostrictive bimetallic strip. This invention is applicable to the omnidirectional diffusion of sound waves by means of a high performance wide pass-band loudspeaker extending throughout the range of audible frequencies.

BACKGROUND OF THE INVENTION

There currently exists an omnidirectional loudspeaker with a spherical membrane, this loudspeaker possessing a wide pass-band and making use of the phenomenon of magnetostriction. This loudspeaker is described, for example, in the application of the European patent No. 0 177 383 filed on Aug. 22, 1985 in the names of the same applicants.

This patent application describes a wide pass-band elastic wave omnidirectional transducer and more specifically a spherical-shaped loudspeaker making use of the phenomenon of magnetostriction.

In one particular embodiment described in this patent, the spherical-shaped omnidirectional loudspeaker is constituted by a strip made of a magnetostrictive material wound into a spiral with an elastic joint joining the spires of the strip; the two extremities of this strip are connected to means so as to apply to the loudspeaker thus obtained, which forms a spherical pulsating membrane, an electric control signal corresponding to the sound waves to be diffused. The two extremities of the strip are situated in two diametrically opposing zones of the pulsating membrane. This loudspeaker also comprises continuous and permanent magnetic polarization means to polarize the pulsating membrane so that the acoustic wave has an amplitude proportional to the control signal applied to the extremities of the strip.

The loudspeaker described in this patent does, however, has one drawback by only exhibiting low power at low frequencies; this imperfection is mainly due to the difficulty of obtaining a significant amplitude of the pulsations of the spherical membrane at low frequencies.

SUMMARY OF THE INVENTION

The object of the present invention is to resolve this drawback and in particular to embody a sperical pulsating membrane loudspeaker providing sufficient acoustic power as regards all frequencies and more particularly at low frequencies. These objectives can be achieved by using a magnetostrictive strip having at least one of its faces totally or partly coated with a thin coating of a material, such as copper, a ceramic, etc. The presence of this thin rigid coating provides the strip, as shall be seen later in detail, with the properties of a bimetallic strip whose deformations are controlled, not by temperature variations, but by applying a modulated electric control current. This current provokes length variations of the magnetostrictive strip which, when subjected to the stresses of the thin rigid coating whose length remains constant, significantly warps at the rate of the amplitude variations of the modulation current.

FIGS. 1*a* and 1*b* make it possible to more readily understand the phenomenon of the magnetostrictive bimetallic strip used in the loudspeaker of the invention.

FIG. 1*a* is a side view of one portion of a magnetostrictive strip M encompassed by a coil B. Where there is no electric current inside the coil B, the strip M has a length L.

When a current is applied to the coil B and in the absence of any permanent continuous magnetic field, the coil induces a magnetic field in the strip which narrows and then has a length L1 just slightly less than L.

FIG. 1*b* laterally represents the magnetostrictive strip M encompassed by the coil B. Here, this strip is coated on one of its faces with a thin coating of a rigid material, such as copper or a ceramic. Where there is no current in the coil B, the strip M and the coating R have a length L.

When a current is applied to the coil B and in the absence of any permanent and continuous magentic field, the magnetostrictive strip M narrows, but the mechanical stresses due to the presence of the rigid thin coating R integral with the strip M provoke the curvature of the unit which then has a length L2. The difference of the L/L2 lengths is clearly much greater than the difference L/L1. This phenomenon is comparable to that of a thermal bimetallic strip whose curvature is caused by the temperature. Here the curvature is due to the narrowing of the magnetostrictive strip subjected to the stresses of the rigid and non-magnetostrictive material of the coating R. The disposition of FIG. 1*b* may be qualified as a "magnetostrictive bimetallic" disposition.

The invention implements this bimetallic strip in a spherical loudspeaker exhibiting sufficient acoustic power as regards the entire range acoustic frequencies and especially at low frequencies.

The object of the invention is to provide an omnidirectional loudspeaker comprising a spherical membrane which includes spires formed of a strip made of a magnetostrictive material spiral-wound according to a sphere, these spires being kept in place by an elastic support so that, along with said support, they form said spherical membrane, this strip having two opposing faces, one of which is directed towards the inside of the sphere, the other being directed outside said sphere, and two extremities situated in two diametrically opposing zones of the sphere so as to be connected to an electric control device supplying a signal corresponding to sound waves to be reproduced, and a device to continuously polarize the membrane, wherein at least one of the faces of the strip is at least partly coated with a thin coating of a rigid material.

According to a first embodiment of the loudspeaker of the invention, the strip is coated with the rigid thin coating on its face directed outside the sphere.

According to another embodiment of the loudspeaker of the invention, the strip exhibits over its entire length transversal undulations, each undulation having on the face of the strip directed towards the inside of the sphere one concave zone and one convex zone and, on the face of the strip directed outside the sphere, one concave zone and one convex zone, the rigid coating being localized at least partly on the face of the strip directed towards the outside of the sphere opposite the convex zones of this face.

According to another embodiment, the strip exhibits over its entire length transversal undulations, each undulation having on the face of the strip directed towards the outside of the sphere one concave zone and one convex zone, the rigid coating being partly localized on each face of the strip opposite the concave zones or opposite the convex zones.

According to another characteristic of the invention, the device for the continuous polarization of the membrane is a permanent magnet situated inside said membrane.

According to another characteristic, the continuous polarization device is a d.c. voltage source connected to the extremities of said strip.

According to another characteristic, said membrane is formed of two hemispheres joined to each other.

BRIEF DESCRIPTION OF THE DRAWINGS

The advantages and characteristics of the invention shall appear more readily from a reading of the following description with reference to the accompanying drawings in which.

DETAILED DESCRIPTION OF THE PREFERRED EMBODIMENTS

Figure 2:
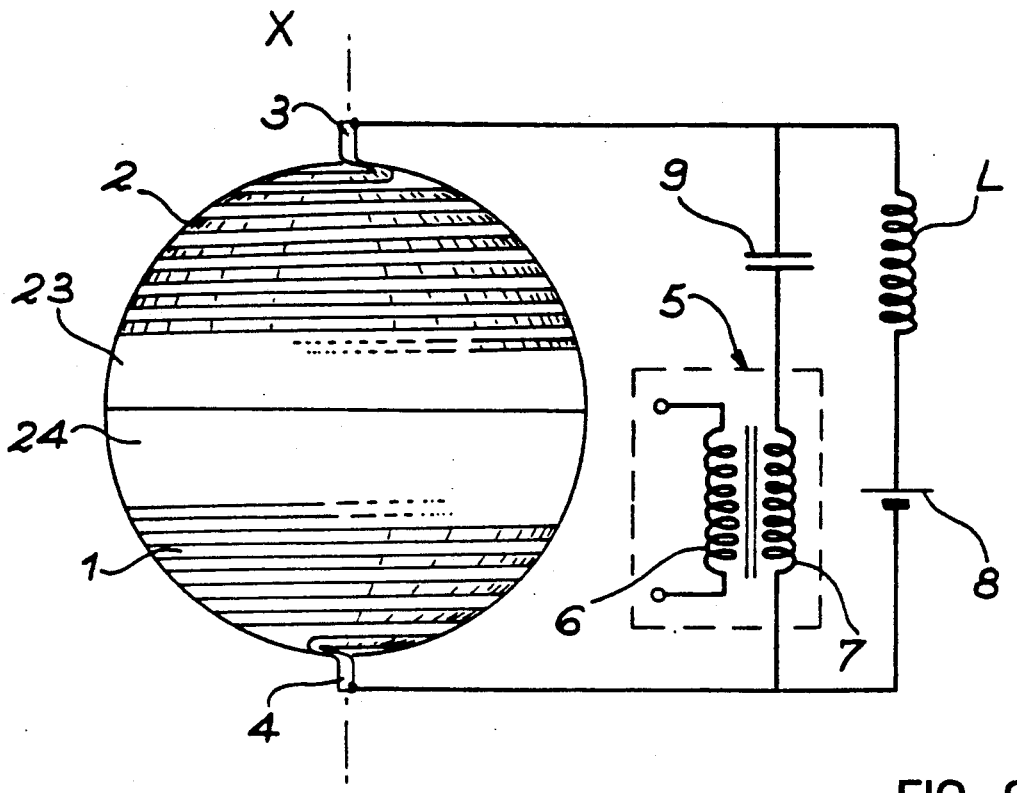
FIG. 2 diagrammatically represents a first embodiment of a loudspeaker according to the invention.

FIG. 2 diagrammatically represents a first embodiment of an omnidirectional loudspeaker conforming to the invention.

This loudspeaker comprises a spherical membrane which includes the spires (2) of a magnetostrictive strip and spiral-wound according to a sphere. These spires are kept in place by an elastic support 1 which may be either a hollow sphere of an elastic nonconducting material to which the spires are glued, or a strip of an elastic material helical-wound according to a sphere, this strip being situated between the spires and being rendered integral with the latter.

Together with the support 1, the strip 2 of the magnetostrictive material forms a spherical membrane.

The strip exhibits two opposing faces, one of which being directed towards the inside of the sphere and the other directed towards the outside of the sphere. According to the invention and as shall be seen later in detail, the strip 2 of the magnetostrictive material comprises on at least one of its faces at least one partial coating of a thin coating of a rigid material, such as copper, a ceramic, etc. It also comprises two extremities 3, 4 situated in two diametrically opposing zones of the spherical shell 1. These extremities are connected to a control device 5 supplying a modulation signal corresponding to sound waves to be reproduced. In this embodiment, this control device may be constituted by a transformer whose primary winding 6 receives the output signal of an amplifier. The secondary winding 7 of this transformer applies this signal to the extremities 3 and 4 of the strip 2. The loudspeaker also comprises a continuous polarization device constituted in this case by an electric d.c. voltage source 8, one of its terminals being connected to the extremity 4 of the strip 2 and the other connected to the extremity 3 of this strip by means of a self-inducting coil L. A bypass capacitor 9 also features on the figure. This capacitor is conventional as regards the connection of a loudspeaker to the output of an amplifier. The d.c. voltage source makes it possible to induce a permanent and continuous magnetic field in the strip.

According to the invention and as shall be seen later in detail, at least one of the faces of the strip 2 has one rigid thin coating totally or partly covering this face. This coating does not appear on this figure and shall be described later.

Figure 1A:
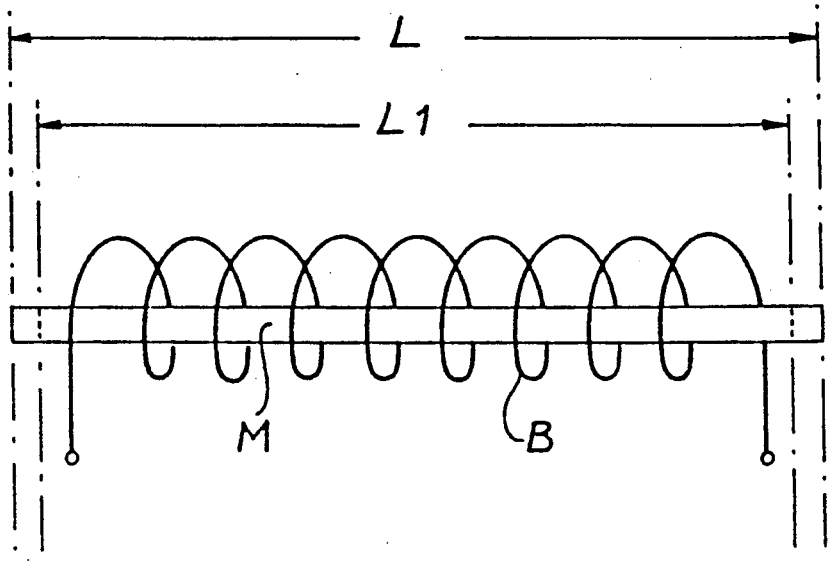
FIGS. 1*a* and 1*b*, already described, make it possible to more readily understand the principle of the magnetostrictive bimetallic strip.
Figure 1B:
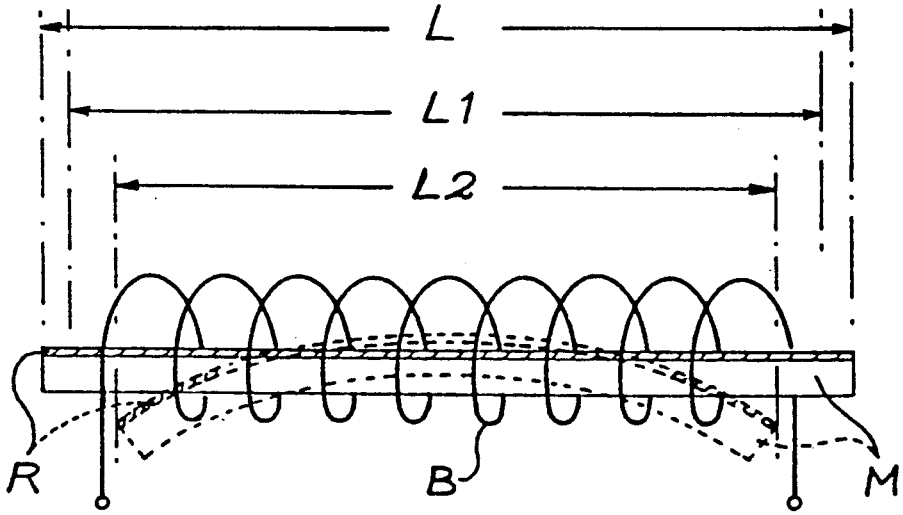
Figure 3:
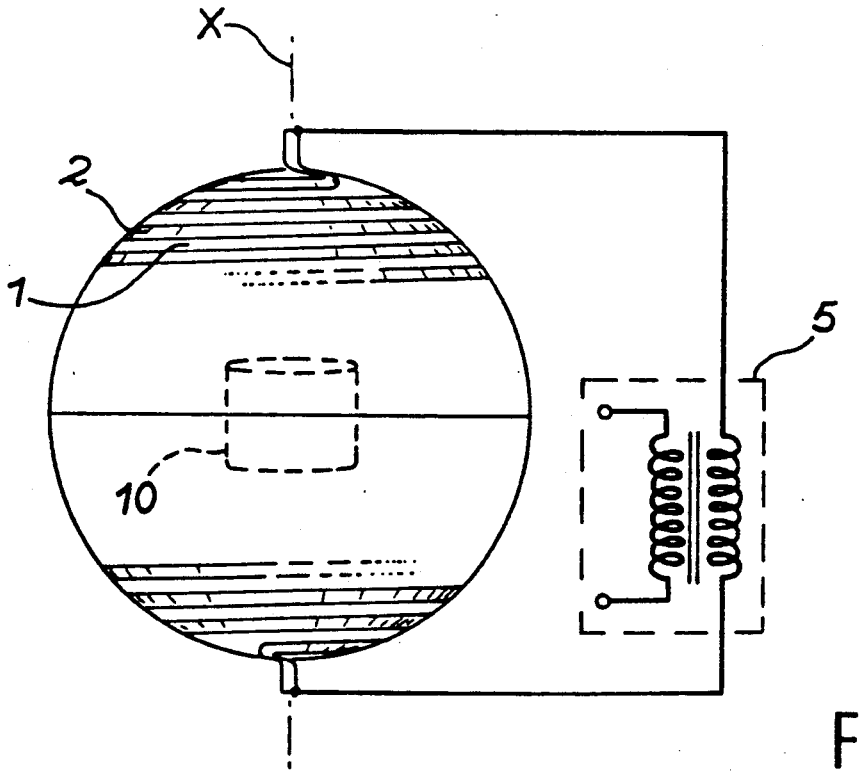
FIG. 3 diagrammatically represents another embodiment of this loudspeaker.

FIG. 3 diagrammatically represents a further embodiment of the loudspeaker of FIG. 1. The device for the continuous polarization of the strip is, in this instance, constituted by a permanent magnet 10 situated inside the spherical membrane. This permanent magnet, having a cylindrical shape for example, has one axis common to the axis X of the loudspeaker. In this case, the d.c. voltage source 8, the self-inducting coil L and the bypass capacitor 9 are not necessary and the secondary winding of the transformer 5 is directly connected to the extremities of the strip 2. According to the invention, at least one of the faces of the strip 2 here also have one thin rigid coating totally or partly coating this face. This coating does not appear on this figure and shall be described subsequently.

Figure 4:
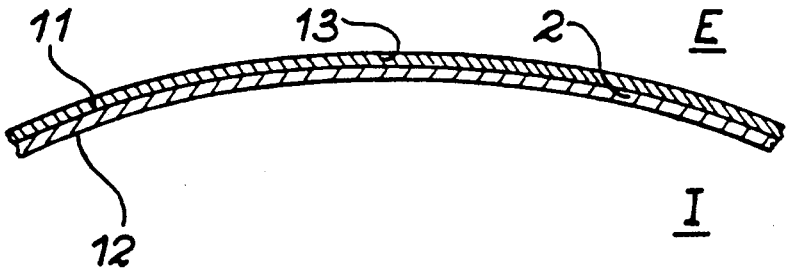
FIG. 4 diagrammatically represents a transversal view of a first variant of a magnetostrictive strip used in the loudspeaker of the invention.

FIG. 4 is a diagrammatic transversal view of one embodiment variant of the magnetostrictive strip coated with a rigid thin coating and used in the loudspeaker of the invention. According to this variant, the magnetostrictive strip 2, which comprises two opposing faces 11, 12 with one (face 12) being directed towards the inside I of the sphere and the other (face 11) being directed towards the outside E of the sphere, is totally coated on its face 11 directed towards the outside of the sphere by a thin rigid coating 13. The magnetostrictive strip may be constituted, for example, by a cobalt-/nickel alloy, whereas the rigid thin coating 13 may be a copper or ceramic coating, for example.

According to the polarity of the current applied to the strip 2 made of a magnetostrictive material covered with the rigid coating 13, this strip undergoes deformations whose amplitudes are proportional to the amplitude variations of the current. Due to the presence of the rigid coating, the strip undergoes deformations which are amplified in the same way as in a thermal bimetallic strip where these are temperature variations which provoke such deformations. Accordingly, the loudspeaker constituted with the aid of such a strip possesses an extremely wide pass-band within the range of audible frequencies, including low frequencies where its power is clearly greater than the spherical loudspeakers of the prior art.

Figure 5:
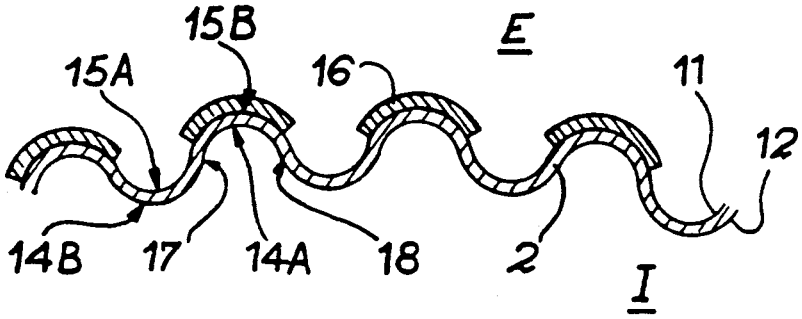
FIGS. 5, 6 and 7 diagrammatically represent lateral views of various other variants of the magnetostrictive strip used in the loudspeaker of the invention.

FIG. 5 diagrammatically represents a side view of another variant of a magnetostrictive strip used in the loudspeaker of the invention. In this case, the strip has over its entire length transversal undulations. Each undulation has on the face 12 of the strip directed towards the inside I of the sphere a concave zone 14A and a convex zone 14B. Each undulation also has on the face 11 of the strip directed towards the outside E of the sphere a concave zone 15A and a convex zone 15B. In this variant, the rigid thin coating does not extend over all of one of the faces of the strip, but is localized, at least partly opposite the convex zones 15B of the face 11 of the strip, said coating being directed towards the outside E of the sphere. This rigid thin coating is represented as 16 on the figure.

The presence of undulations significantly increases the amplitudes of deformations to which the magnetostrictive strip 2 is subjected when an electric current with a variable frequency and amplitude is applied to it. In fact, the edges, such as 17 and 18, of the convex zone 15B of the undulation clearly draw close to each other in proportion to the amplitude of the electric current applied due to the presence of the copper coating 16 which provokes the bimetallic effect described earlier.

Figure 6:
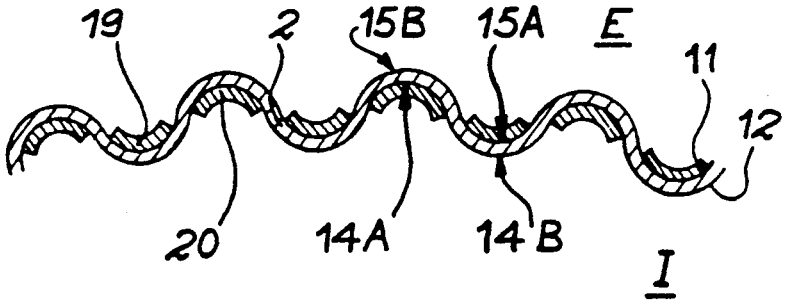

FIG. 6 diagrammatically represents a side view of another variant of the magnetostrictive strip. In this variant and so as to further increase the amplitudes of the deformations of the strip, especially at low frequencies, the magnetostrictive strip has transversal undulations over its entire length. As in the preceding embodiment, each undulation on its face 12 directed towards the inside I of the sphere has one concave zone 14A and one convex zone 14B, and on its face 11 directed towards the outside of the sphere one concave zone 15A and one convex zone 15B. The rigid coating here is partly localized opposite the concave zones 14A and 15A of each face of the strip. These thin rigid localized coatings are represented as 19 and 20 on the figure. The passage of the electric current in the strip here provokes a spacing of the edges of the undulations.

Figure 7:
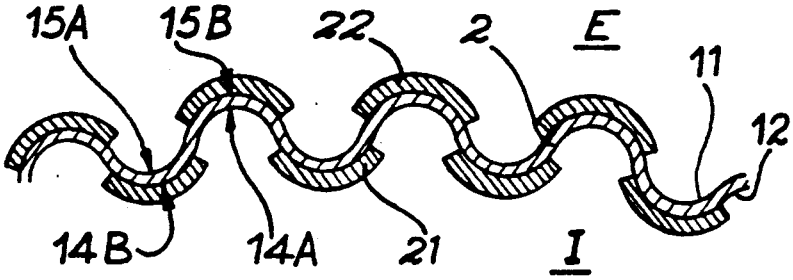

FIG. 7 diagrammatically represents a side view of another variant of a magnetostrictive strip used in the loudspeaker of the invention. The thin rigid coating is in this instance partly deposited on each of the faces of the strip opposite the convex zones 14B and 15B of the undulations. These localized rigid thin coatings are represented as 21 and 22 on the figure. As in the preceding embodiment, the amplitude of the deformations of the strip, especially at low frequencies, is highly considerable due to the bimetallic effect of the structure of the strip described. Passage of the electric current in the strip here provokes a drawing together of the edges of the undulations.

So as to facilitate the embodiment and especially when the continuous polarization source is constituted by a permanent magnet, the constituted membrane of the strip 2 partially covered with the rigid material and the elastic support 1 may be formed of two hemispheres, represented as 23 and 24 on FIG. 1. These two hemispheres are rendered integral by, for example, glueing the support and by welding two half-strips each corresponding to one of the hemispheres.

The preferred embodiments of the loudspeaker described immediately above are the ones which use the bimetallic effect magnetostrictive strip with an undulated form. In fact, it is this undulated form which procures the best possible acoustic efficiency and which ensures the simplest production of the spherical loudspeaker.

What is claimed is:

1. Omnidirectional loudspeaker comprising a spherical membrane which includes spirals formed by a strip made of a magnetostrictive material, said spirals being wound onto an elastic support in the shape of a sphere, thus forming said spherical membrane, the strip having two opposing faces, one of said faces being directed towards the inside of the sphere and the other towards the outside of said sphere, and two extremities situated in two diametrically opposing zones of the sphere so as to be connected to an electric control device supplying a signal corresponding to sound waves to be reproduced, and a device to continuously polarize the membrane, wherein at least one of the faces of the strip is at least partly coated with a thin coating made of a rigid material, the strip having over its entire length transversal undulations, each undulation having on the face of the strip directed towards the inside of the sphere one concave zone and one convex zone, and on the face of the strip directed towards the outside of the sphere one concave zone and one convex zone, the rigid coating being localized at least partly on the face of the strip directed towards the outside of the sphere opposite the convex zones.

2. Loudspeaker according to claim 1, wherein the device to continuously polarize the membrane is a permanent magnet situated inside said membrane.

3. Loudspeaker according to claim 1, wherein the continuous polarization device is a d.c. voltage source connected to the extremities of said strip.

4. Loudspeaker according to claim 1, wherein said membrane is formed of two hemispheres joined to each other.

5. Loudspeaker according to claim 1, wherein the strip is also coated by the thin rigid coating on its face directed towards the inside of the sphere.

6. Loudspeaker according to claim 5, wherein the device to continuously polarize the membrane is a permanent magnet situated inside said membrane.

7. Loudspeaker according to claim 5, wherein the continuous polarization device is a d.c. voltage source connected to the extremities of said strip.

8. Loudspeaker according to claim 5, wherein said membrane is formed of two hemispheres joined to each other.

9. Omnidirectional loudspeaker comprising a spherical membrane which includes spirals formed by a strip made of a magnetostrictive material, said spirals being wound onto an elastic support in the shape of a sphere, thus forming said spherical membrane, the strip having two opposing faces, one of said faces being directed towards the inside of the sphere and the other towards the outside of said sphere, and two extremities situated in two diametrically opposing zones of the sphere so as to be connected to an electric control device supplying a signal corresponding to sound waves to be reproduced, and a device to continuously polarize the membrane, wherein at least one of the faces of the strip is at least partly coated with a thin coating made of a rigid material, the strip having over its entire length transversal undulations, each undulation having on the face of the strip directed towards the inside of the sphere one concave zone and one convex zone, the rigid coating being localized partly at each undulation of the strip at at least the concave zones or the convex zones.

10. Loudspeaker according to claim 9, wherein the device to continuously polarize the membrane is a permanent magnet situated inside said membrane.

11. Loudspeaker according to claim 9, wherein the continuous polarization device is a d.c. voltage source connected to the extremities of said strip.

12. Loudspeaker according to claim 9, wherein said membrane is formed of two hemispheres joined to each other.

* * * * *